United States Patent [19]

Mayer et al.

[11] 3,995,700

[45] Dec. 7, 1976

[54] HYDRAULIC ROCK DRILL SYSTEM

[75] Inventors: James R. Mayer; Dieter K. Palauro, both of Denver, Colo.

[73] Assignee: Gardner-Denver Company, Dallas, Tex.

[22] Filed: Oct. 14, 1975

[21] Appl. No.: 621,935

[52] U.S. Cl. ..... 173/2; 91/277; 91/291; 91/308; 173/115; 173/134; 173/DIG. 4

[51] Int. Cl.[2] ..... E21C 3/20

[58] Field of Search ..... 91/277, 291, 289, 321, 91/308, 461; 173/115, 134, 2

[56] References Cited

UNITED STATES PATENTS

| | | | |
|---|---|---|---|
| 3,552,269 | 1/1971 | Arndt | 91/277 X |
| 3,554,085 | 1/1971 | Butterworth | 91/277 X |
| 3,682,253 | 8/1972 | McIntosh | 173/43 X |
| 3,741,072 | 6/1973 | Romell | 91/277 X |
| 3,800,664 | 4/1974 | Phillips | 91/308 |
| 3,865,013 | 2/1975 | Mastaj | 91/461 X |
| 3,908,767 | 9/1975 | Klemm | 173/78 |
| 3,910,358 | 10/1975 | Martinek | 173/152 |

*Primary Examiner*—Ernest R. Purser
*Attorney, Agent, or Firm*—Michael E. Martin

[57] ABSTRACT

In a hydraulic percussion rock drill the operation of the working fluid distributing valve is controlled to effect a variation in percussive blow energy and blow frequency by varying the piston hammer stroke. Actuation of the distributing valve is controlled by a remote controlled hydraulically actuated pressure control valve interposed in a fluid passage which conducts hydraulic fluid from the hammer bore to actuate the distributing valve. Substantially infinite variation of hammer impact blow energy between high and low limits provides for selecting the maximum penetration rate of the drill for any type of rock conditions. The hydraulic rock drill is connected to a source of hydraulic fluid supplied to the drill at substantially constant fluid power by a variable displacement constant power hydraulic pump.

17 Claims, 6 Drawing Figures

HYDRAULIC ROCK DRILL SYSTEM

BACKGROUND OF THE INVENTION

This invention pertains to the art of rock drilling with pressure fluid actuated percussion type drills wherein repeated impact blows are transmitted through a drill stem comprising one or more elongated rods or tubes coupled end to end and connected to a percussion bit which penetrates a rock formation by localized fracture and crushing of the rock structure.

It has been observed in pursuing the present invention that a rock formation of a particular hardness or compressive strength can be penetrated with the aforementioned type of drilling most efficiently, that is the greatest rate of hole formation for a given rate of energy input to the rock drill proper, at a particular impact blow energy value taking into consideration the configuration and size (diameter) of the percussion bit. An impact blow which has a low energy value will deflect the rock formation but not sufficiently to cause substantial fracture and breaking up of the rock structure. Accordingly, since most rock formations exhibit a stiffness characteristic and undergo elastic deflection when subjected to impacts a major portion of the energy of an impact blow imparted to the rock may be reflected back through the bit and the drill stem or dissipated into the rock formation without effecting very much rock fracture. Operation of a percussion drill at a hammer blow energy which is too low will result in very slow penetration or hole formation and an early failure of the drill stem components as well as substantial loss of the energy or power consumed in operating the drill.

Conversely, it is believed that if the impact blow energy is too high that penetration of the bit and breaking of the rock will occur but that at least some elastic compressive deflection of the drill stem and bit caused by the impacting of the hammer cannot be transmitted substantially to the rock formation once initial breaking and penetration has taken place because the bit will not remain in firm contact with the unbroken rock. Therefore, at least some of the impact blow energy cannot be transmitted to the rock formation and instead causes cyclical compression and elongation of the drill stem which is undesirable. If the impact blow energy is too high for a particular type of rock being drilled early fatigue failures of the drill stem components and bit is also experienced and energy is wasted.

It has been further observed that a rock formation of a particular compressive strength (as measured by uniaxial loading of a finite sample) requires a certain energy value to break out or remove a unit volume of rock by percussion drilling. It follows then that in percussion drilling of circular cross section holes with bits which have a fixed ratio of cutting edge length to bit diameter it would be desirable to maintain a fixed value of impact energy per unit of bit diameter for drilling holes of various sizes in a given type of rock. Accordingly, depending on hole size the total impact blow energy imparted to the bit by the hammer should be adjusted to provide the requisite blow energy for a given hole size which will be the most efficient or yield the greatest penetration rate for the power input to the drill proper.

In pursuing the present invention it has been determined that a percussion drill motor operated by hydraulic pressure fluid and capable of imparting to the drill stem and bit impact blows of variable intensity or energy value may be advantageous for drilling in different types of rock in the most efficient manner. Moreover, such a drill may also be used to drill more efficiently a range of hole sizes within the working limits of the drill system in regard to the impact blow energy delivered to the drill stem and bit and total power input to the drill which will not materially reduce the useful life of the drill or the drill stem components.

Percussion type rock drills are known which are capable of being controlled to deliver variable impact blow energy and blow frequency. Prior art drills are generally characterized by control devices which require direct access to the rock drill unit itself to effect a change in hammer stroke length and blow frequency. Prior art hammer stroke length and blow frequency controls are also generally characterized by devices which provide for a finite number of different drill operating frequencies and hammer stroke lengths none of which might be the most effective for drilling a particular type of rock in accordance with the foregoing observations.

Furthermore, in known drills of the type which operate on hydraulic pressure fluid supplied by a conventional motor driven pump the changes in fluid flow rate and supply pressure caused by changes in hammer stroke length or blow frequency do not permit operation of the drill unit at a substantially constant rate of hydraulic power input to the drill itself. Accordingly, the improvements in drill penetration rate for a particular type of rock or hole size which could be achieved with changing the impact blow energy are not realized because the necessary changes in fluid flow and pressure cannot be accomplished to provide a substantially constant hydraulic power input to the drill percussion mechanism.

SUMMARY OF THE INVENTION

The present invention provides an improved pressure fluid actuated percussion rock drill system wherein the impact blow energy delivered from the piston hammer to the drill stem and bit may be varied to thereby achieve the maximum rate of rock removal for a particular type of rock being drilled and for a particular bit size and configuration.

The rock drill system of the present invention includes a hydraulic pressure fluid actuated percussion drill which includes means for changing the impact blow energy to substantially any value between and including high and low limits whereby the greatest penetration rate of the drill may be easily selected without predetermination of the requisite impact blow energy setting for the type of rock or the size hole being drilled.

In accordance with the present invention there is provided a hydraulic pressure fluid operated rock drill which includes means for changing the hammer impact blow energy to substantially any selected value within the drill operating limits, which means may be operated at a remote location with respect to the drill proper and while the drill is in operation. A preferred embodiment of the drill comprises a percussion mechanism including a piston hammer which is reciprocated by intermittent valving of pressure fluid to one of a pair of opposed pressure surfaces formed on the piston hammer. Impact blow energy is varied by changing the hammer stroke length and hammer velocity at impact of the drill stem through control of the movement of a pressure fluid distributing valve which supplies pressure fluid to effect oscillation of the hammer. Stepless control of valve movement with respect to the hammer position provides for infinitely variable hammer blow energy between the high and low limits which are defined in part by the particular size and configuration of the percussion mechanism itself.

The rock drill system of the present invention is also adapted for remote control of the hammer impact blow energy by the drill operator. Selection of the maximum drilling rate may be determined by the drill operator or attendant by changing the pressure setting of a fluid control circuit until the maximum drilling rate is observed. Moreover, the mechanism provided for remote control of the drill impact blow may be easily adapted to an automatic control system for producing the maximum drilling rate.

The present invention further provides for a hydraulic percussion rock drill system in which a substantially constant rate of energy is supplied to the drill proper in the form of hydraulic fluid at variable pressures and flow rates whereby the drill may be operated with the same fluid power input to the drill regardless of the hammer impact blow energy setting of the drill. By providing a hydraulic rock drill system which includes a variable impact blow rock drill in combination with a source of hydraulic pressure fluid which is automatically controlled to provide substantially constant fluid power at various combinations of pressure and flow rate to the drill proper the drill may be operated at the most effective drilling rate for most types of rock formations and drill hole diameters. In a preferred embodiment of the present invention the source of constant hydraulic fluid power is a variable displacement pump of the so-called "constant power" type. However, any combination of pump and prime mover may be used which is adapted to automatically provide hydraulic pressure fluid at various combinations of pressure and flow rate which will produce substantially constant fluid power input to the rock drill.

DESCRIPTION OF THE PREFERRED EMBODIMENTS

Figure 1:
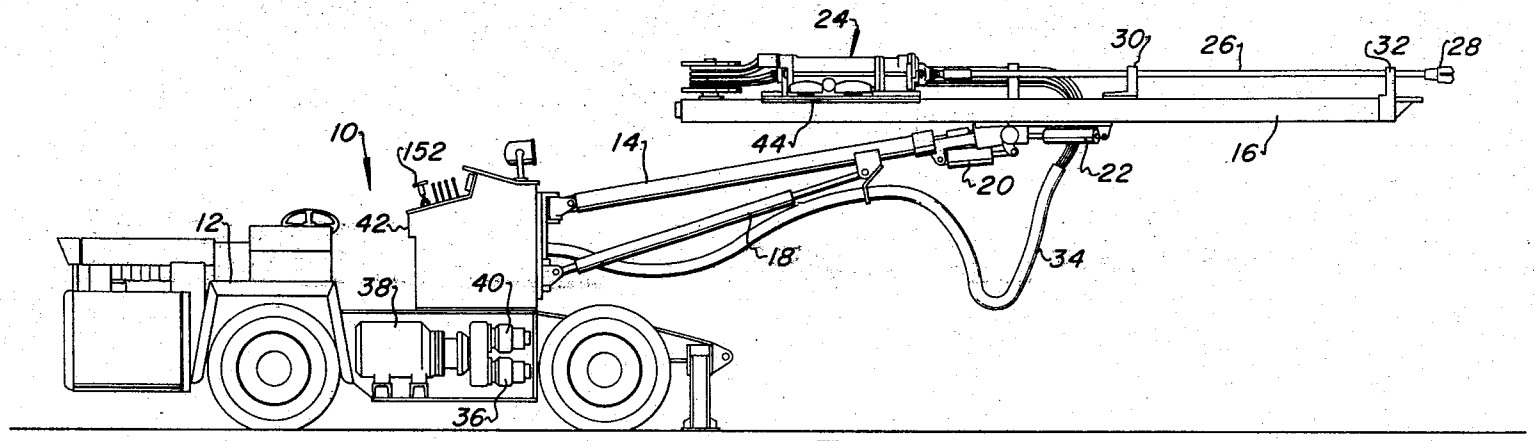
FIG. 1 is a side elevation of a portable drilling unit including the rock drill system of the present invention.

The rock drill system of the present invention may be adapted to various types of drilling apparatus. A typical drill rig which is suited for use of the improved rock drill system is illustrated in FIG. 1 and generally designated by the numeral 10. The drill rig 10 includes a self-propelled wheel type undercarriage 12 upon which is mounted a movable boom 14. A rock drill feed support 16 is pivotally supported on the distal end of the boom 14. Suitable mechanism such as hydraulic cylinder type linear actuators 18, 20, and 22 are operable to position the feed support so that holes may be drilled in various directions. A hydraulic percussion rock drill 24 is slidably disposed on the feed support 16 and is connected to suitable mechanism, not shown, for advancing and retracting a percussion drill stem 26 and bit 28 with respect to the feed support 16. The drill stem 26 may be made up of one or more elongated hollow rods or tubes and suitably coupled to a member disposed in the drill 24 which is adapted to transmit impact blows to the drill stem. The bit 28, coupled to the drill stem 26, may be of a conventional percussion type provided with a plurality of hard metal inserts which are wedge shaped to provide cutting edges for impacting the rock surface. Suitable guides 30 and 32 are provided on the feed support 16 for guiding the drill stem 26 in a known way.

Hydraulic pressure fluid is supplied to and conducted from the drill 24 by flexible conduits or hoses which are in circuit with control valves and other attendant devices including a reservoir disposed on the undercarriage 12. The hoses are suitably supported by a flexible boot 34. Hydraulic fluid at variable pressure and flow rate is supplied to operate the drill 24 by a pump 36 which is driven by an electric motor 38 mounted on the undercarriage 12. The motor 38 is also drivingly connected to a second pump 40 for supplying hydraulic fluid to operate the actuators 18, 20, and 22 and the feed mechanism for the drill 24. The operation of the drill rig 10 including the drill 24 is controlled by an operator person from a control station 42 on the undercarriage 12.

Figure 2:
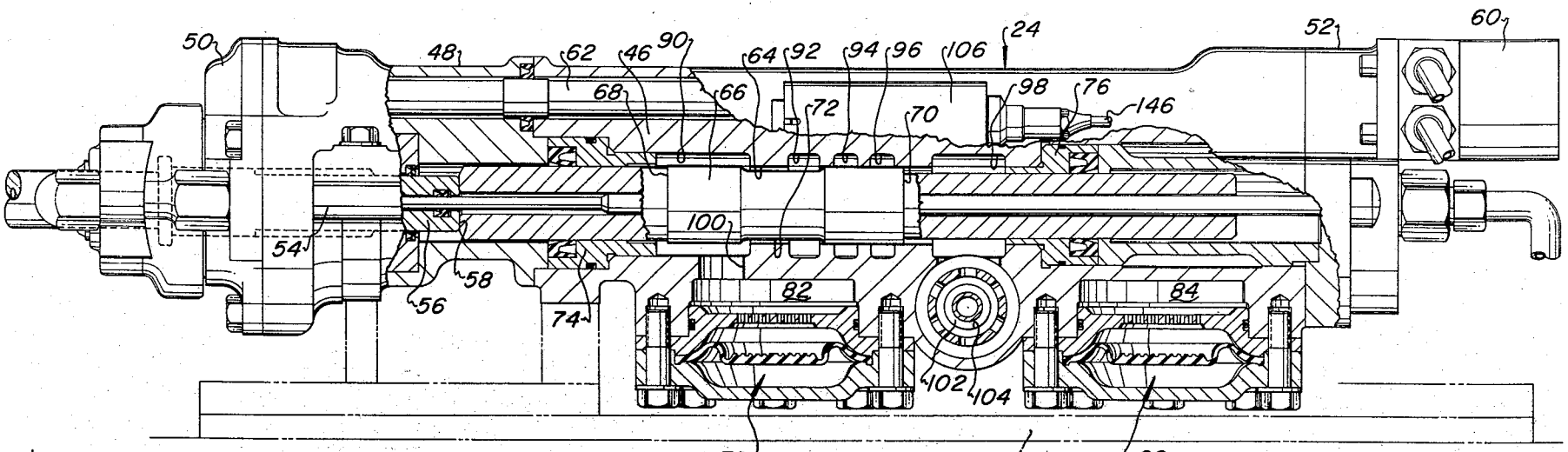
FIG. 2 is a longitudinal section view of a hydraulic percussion rock drill in accordance with the present invention.

Referring to FIG. 2 the drill 24 is shown in a longitudinal side elevation, partially sectioned, to illustrate details of the percussion mechanism. The drill 24 is mounted on a slide 44 which is adapted to be slidably disposed on the feed support 16. The drill 24 is characterized by a main casing formed in two separable parts 46 and 48 which are held in assembly between end covers 50 and 52 by suitable elongated bolts 54, one shown. The casing part 48 rotatably supports an impact blow receiving member 56 which is coupled to the drill stem 26 shown in FIG. 1 in a well known manner. The member 56 includes a transverse face 58 which is disposed to receive repeated impact blows from an elongated piston hammer 66 to be described hereinbelow. A rotary motor 60 mounted on the end cover 52 is drivingly connected to the member 56 through an elongated drive shaft 62 and suitable speed reduction gearing disposed within the casing part 48. The member 56 is rotatably driven by the motor 60 for rotating the drill stem and bit.

The casing part 46 includes a longitudinal cylindrical bore 64 in which is reciprocably disposed the piston hammer 66. The hammer 66 is characterized by two oppositely facing transverse pressure surfaces 68 and 70 and an annular channel 72, shown in FIG. 3 also. The area of pressure surface 70 is greater than the area of surface 68. The hammer 66 is supported by two spaced apart bearings 74 and 76 disposed in the casing part 46 and including suitable end seals.

Figure 3:
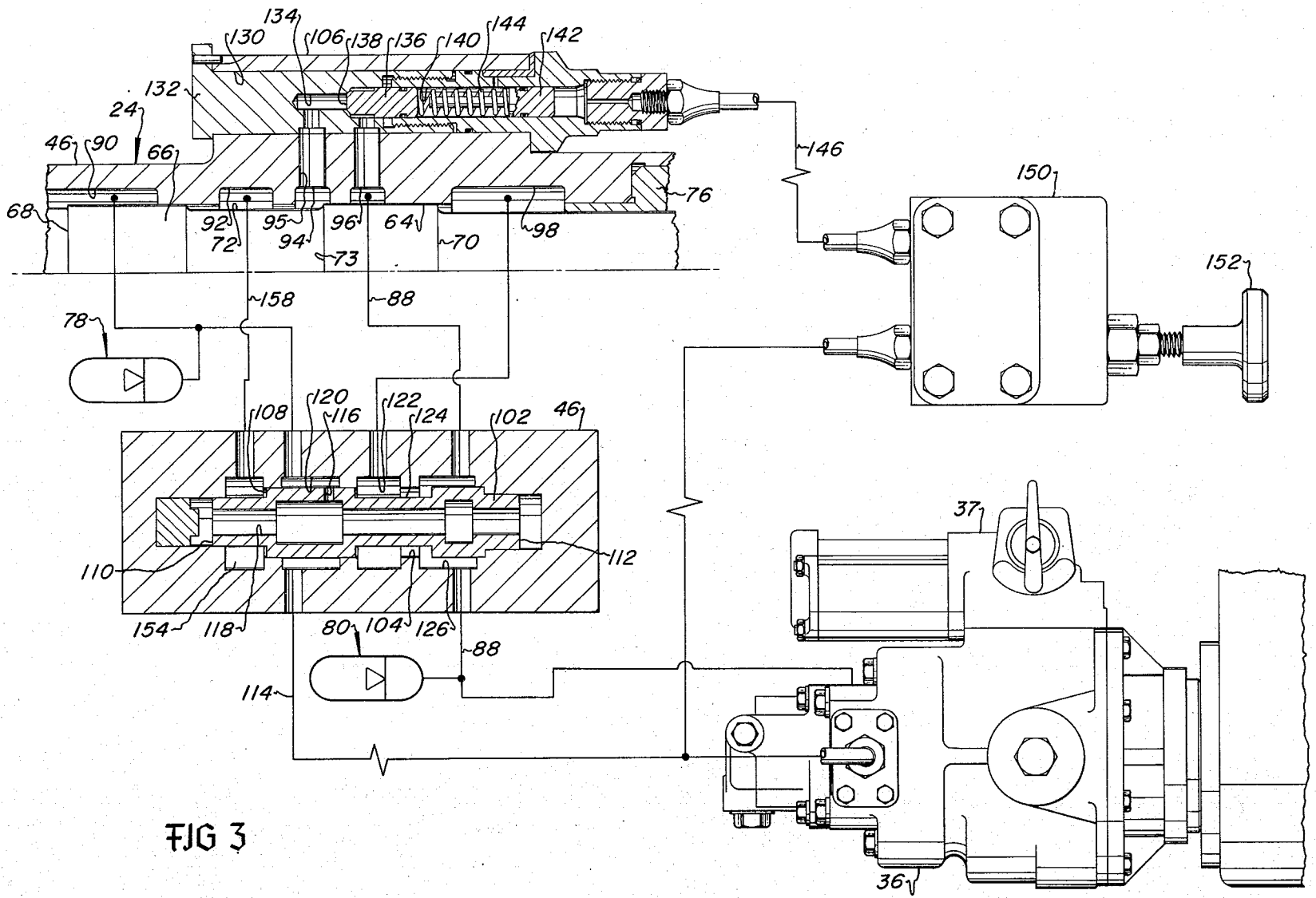
FIG. 3 is a schematic illustrating the control circuit of the rock drill system of the present invention.

The drill 24 also includes two gas charged flexible diaphragm type accumulators 78 and 80. The accumulator 78 includes a chamber 82 which is in communication with a source of high pressure hydraulic fluid by way of suitable conduits within the casing part 46. The accumulator 80 is characterized by a chamber 84 which is in communication with a low pressure return line 88, shown schematically in FIG. 3. The positions of the accumulators 78 and 80 with respect to the hydraulic fluid flow circuit of the drill 24 are also shown in FIG. 3.

The casing part 46 includes spaced apart annular grooves 90, 92, 94, 96, and 98 which open into the bore 64. A passage 100 leads from the accumulator chamber 82 to the groove 90 and communicates high pressure hydraulic fluid into the bore 64 to act continuously against the pressure surface 68 when the drill is in operation. When the hammer 66 is in the impact position shown in FIG. 2, the annular channel 72 in the hammer also communicates high pressure fluid to the groove 92.

The drill 24 further includes a pressure actuated fluid distributing valve 102 disposed in a transverse bore 104 in the casing part 46 and between the accumulators 78 and 80. The valve 102 comprises a hollow cylindrical spool which is disposed to be hydraulically actuated to conduct pressure fluid to and from the groove 98 and the portion of the bore 64 in communication therewith and which is also in communication with the pressure surface 70. When high pressure fluid is conducted to the groove 98 a pressure force acting on the surface 70 causes hammer 66 to accelerate to deliver an impact blow to the member 56. When the groove 98 is vented to the low pressure return line 88 through the valve 102 the fluid pressure acting on surface 68 returns the hammer to a position whereby high pressure fluid is again conducted to the groove 98 upon actuation of the valve.

The operation of the valve 102 and hammer 66 together with means for varying the impact blow energy transmitted by the hammer to the member 56 will now be described in detail with reference to FIG. 3. Although the valve 102 is mounted in the drill 24 for movement in a direction transverse to the disposition and movement of the hammer the valve is shown in FIG. 3 in schematic form in longitudinal section to facilitate an understanding of its operation. FIG. 3 also illustrates the mechanism for changing the working stroke and impact blow energy of the hammer 66 which mechanism is disposed in a portion 106 of the casing part 46 also shown in FIG. 2.

The valve 102 includes transverse pressure surfaces 108 and 110 which may be acted on by high pressure fluid to move the valve to the position shown in FIG. 3. The total area of surfaces 108 and 110 is greater than the area of an oppositely facing pressure surface 112. However, the area of pressure surface 112 is greater than the area of pressure surface 110. High pressure fluid at the supply pressure to the drill is conducted to the valve through a conduit 114 and through passages 116 and the hollow interior 118 to act continuously on the surfaces 110 and 112. Accordingly, the valve 102 is moved to a position in the bore 104 opposite to the position shown in FIG. 3 when there is insufficient pressure acting on surface 108 which together with the pressure acting on surface 110 can overcome the force caused by pressure on surface 112. Circumferential grooves 120, and 122 cooperate with an annular recess 124 on the valve 102 to conduct pressure fluid from supply conduit 114 to the groove 98 to act on the surface 70 when the valve is shifted to the position opposite that shown in FIG. 3. In the position of the valve 102 shown in FIG. 3 grooves 122 and 126 in the bore 104 are placed in communication with each other by way of the recess 124 and pressure fluid is discharged from the chamber formed by the groove 98 to the low pressure return line 88. The groove 90 in the bore 64 is continuously in communication with high pressure fluid supplied by way of groove 120 surrounding the valve 102 and the groove 96 in the bore 64 is continuously in communication with the low pressure return line 88 by way of the groove 126.

As shown in FIG. 3 the portion 106 of the casing part 46 includes a bore 130 in which is disposed means for controlling the shifting of the valve 102 from the position shown to the position in which pressure is conducted to the groove 98. The control of shifting of the valve 102 to introduce pressure fluid to groove 98 has the effect of changing the length of the impact stroke of the hammer 66 and the impact velocity as well. Accordingly, the impact blow energy may be controlled by changing the hammer stroke length with the drill 24 in combination with the drill system shown in FIG. 3.

The bore 130 contains a two-piece plug 132 having a passage 134 in communication with the groove 94 by way of a conduit 95. A seat is formed at one end of the passage 134 against which is disposed a movable valve closure member 136 having a transverse pressure surface 138. The groove 96 in the casing part 46 is in communication with an enlarged bore 140 in which the closure member is disposed. The bore 140 also contains a piston 142 and a coil spring 144 interposed between the piston and the closure member 136. Hydraulic fluid is supplied by way of a conduit 146 to act on the piston 142 for biasing the closure member 136 in the seated or closed position shown in FIG. 3.

The pressure of the fluid supplied to the piston 142 may be varied by a pressure regulator 150 having an operating member in the form of a pressure adjusting control knob 152. The pressure regulator 150 receives high pressure fluid from the discharge conduit 114 of the hydraulic pump 36 which also supplies hydraulic fluid to reciprocate the hammer 66. The pressure regulator 150 is advantageously disposed at the control station 42 for adjustment by the drill operator at will. The regulator 150 is of a well known type which provides a reduced pressure of a constant value depending on the setting of the operating or adjusting member 152. The particular regulator shown in FIG. 3 is a model QWA3-165 manufactured by Double A Products Co., Manchester, Michigan, U.S.A.

The basic operation of the drill system of the present invention will now be described with reference to both FIGS. 2 and 3. When the hammer 66 reaches the impact position shown in FIG. 2 the groove 92 is placed in communication with groove 90 by way of channel 72 in the hammer and high pressure fluid is conducted to a chamber 154 to act on pressure surface 102 which will shift the valve 102 to the position shown in FIG. 3. In the position shown in FIG. 3 the pressure surface 70 on the hammer 66 is exposed to the low pressure in the return line 88. Accordingly, high pressure fluid acting continuously on the surface 68 moves the hammer to the right, viewing FIGS. 2 and 3. As the hammer 66 moves through the return stroke the valve 102 is held in the position shown in FIG. 3 by pressure fluid trapped in the chamber 154 and conduit 158 as the channel 72 on the hammer moves out of communication with groove 90.

As the hammer 66 continues moving to the right on the return stroke the channel 72 moves into communication with the groove 94 and the pressure of the fluid in the chamber 154 and conduit 158 is transmitted to act on the surface 138 or closure member 136. The fluid pressure acting on surface 112 of the valve 102 will cause the valve to commence movement to shift to the left, viewing FIG. 3, when the fluid pressure acting on the surface 138 increases sufficiently to open the closure 136. When the valve 102 has shifted to place the high pressure supply conduit 114 in communication with the groove 98 high pressure fluid will act on surface 70 causing the hammer to be brought to rest and then accelerated in the opposite direction (to the left) on the impact stroke. Just prior to impacting the member 56, the channel 72 will come into communication with the groove 90 and high pressure fluid will again be transmitted to chamber 154 causing the valve 102 to shift to the position shown in FIG. 3.

As may be appreciated from the foregoing description by adjusting the pressure of fluid acting on the piston 142, which controls the compression of spring 144, movement of the closure member 136 to relieve the pressure in chamber 154 can be controlled and shifting of the valve 102 can be varied with respect to the position of the hammer 66. When the pressure acting on the piston 142 is increased to the supply pressure the closure member 136 will not open and the valve 102 will be shifted only after the channel 72 in the hammer places the grooves 92 and 96 in communication with each other, which will result in the maximum hammer stroke length and greater velocity at impact. Accordingly, a substantially stepless control of the stroke length of and the impact blow energy delivered by the hammer may be obtained by the timing of the shifting of the valve 102. If the valve 102 is shifted very soon upon commencing communication of the groove 92 with the groove 94 the hammer stroke length will be short and the hammer velocity at impact reduced. Therefore, the impact blow energy will be relatively low also. When the hammer stroke is short the total time to complete one cycle of oscillation is less and the frequency of oscillation and impact may be increased. Conversely, when the hammer stroke is relatively great the impact frequency will decrease. However, the total energy rate transmitted to the drill stem and bit may remain substantially constant and the impact energy per blow of the hammer 66 may be controlled to provide the greatest penetration rate in accordance with the type of rock and the bit.

It has been observed with hydraulic pressure fluid operated percussion drills of the general type described herein and particularly also characterized by a shiftable valve for effecting oscillation of the piston hammer that when the drill is operated at progressively shorter hammer stroke lengths the resistance to flow of working fluid through the drill increases relative to the flow conditions at the longer stroke lengths operation. This results in a higher operating pressure for a given input flow rate of working fluid. Therefore, in order to provide for operation of the drill at the maximum allowable power and prevent imparting too high an input power to the drill it is desirable to adjust the flow and pressure of the hydraulic working fluid to maintain a constant rate of fluid energy input to the drill proper.

It has been determined in pursuing the present invention that operator controlled adjustment of the fluid flow rate to the drill when changing the hammer stroke length is difficult and very time consuming and often does not result in improved drilling rates. Such is the case because upon changing the stroke length it is necessary to hunt for the combination of fluid pressure and flow rate which will produce the desired power input to the drill which will result in the faster drilling rate which was sought by changing the hammer impact blow energy. Accordingly, it is highly desirable to have a source of pressure fluid which is automatically controlled to provide constant fluid power input to the drill proper regardless of the change in hammer stroke length.

With the rock drill system of FIG. 3 the input fluid power to the drill is controlled to be substantially constant by a particular type of variable displacement hydraulic pump which includes controls which automatically adjust the flow rate in accordance with changes in discharge pressure which will occur as the stroke length of the drill hammer is adjusted. Although various types of pumps and controls therefor can be adapted to automatically supply fluid at a substantially constant power the pump 36, shown in FIG. 3, is of a type manufactured by New York Air Brake Co., Watertown, N.Y. under the trademark Dynapower and is specifically designated as a model 45, phase IV equipped with a constant horsepower control mechanism disposed on the pump and generally designated by the numeral 37.

Figure 4:
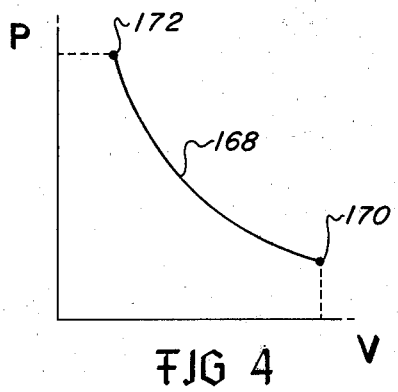
FIG. 4 is a graph illustrating the basic performance characteristic of the hydraulic fluid pump of FIG. 3; and, FIGS. 5 and 6 illustrate an alternate embodiment of the mechanism for changing the stroke length of the drill piston hammer.

Referring to FIG. 4, the graph illustrates the basic performance characteristic of the pump 36. The abscissa of the graph is designated V and represents increasing output fluid volume flow of the pump 36. The ordinate is designated P and represents increasing discharge fluid pressure. The line 168 represents a line of substantially constant fluid horsepower delivered by the pump 36. The pump 36 may operate at any point on the line between the point of maximum volume displacement 170 and the point of maximum pressure 172 as controlled by the inbuilt control 37 provided for the particular pump specified herein.

In the schematic control circuit of FIG. 3 conventional components such as heat exchangers, the pump replenishing circuit, and drain lines from the pump 36, and control valve 150 have been omitted for the sake of clarity and conciseness. Pressure fluid is discharged from the pump 36 by way of conduit 114 which supplies the drill 24 and the control valve 150. Fluid discharged from the drill 24 is returned to the pump by way of return line 88 which is maintained at a low pressure relative to the discharge pressure of the pump.

Figure 5:
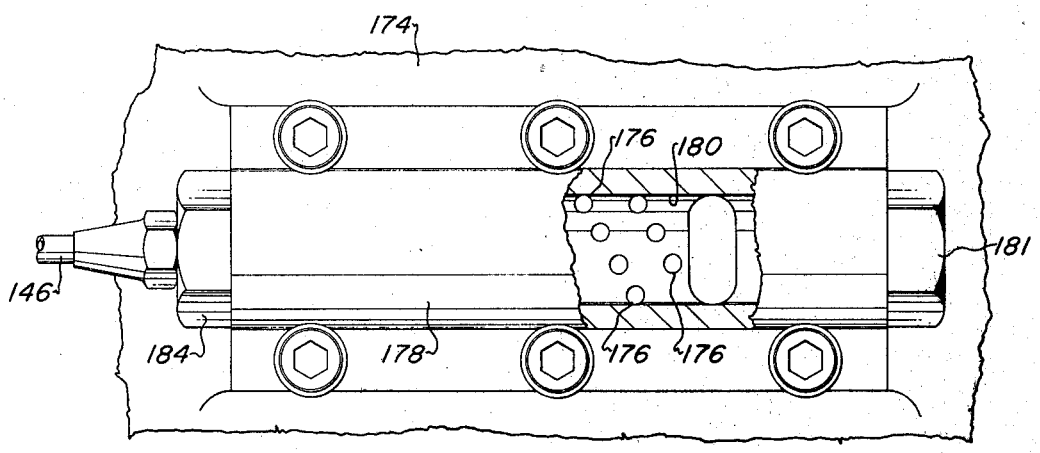
Figure 6:
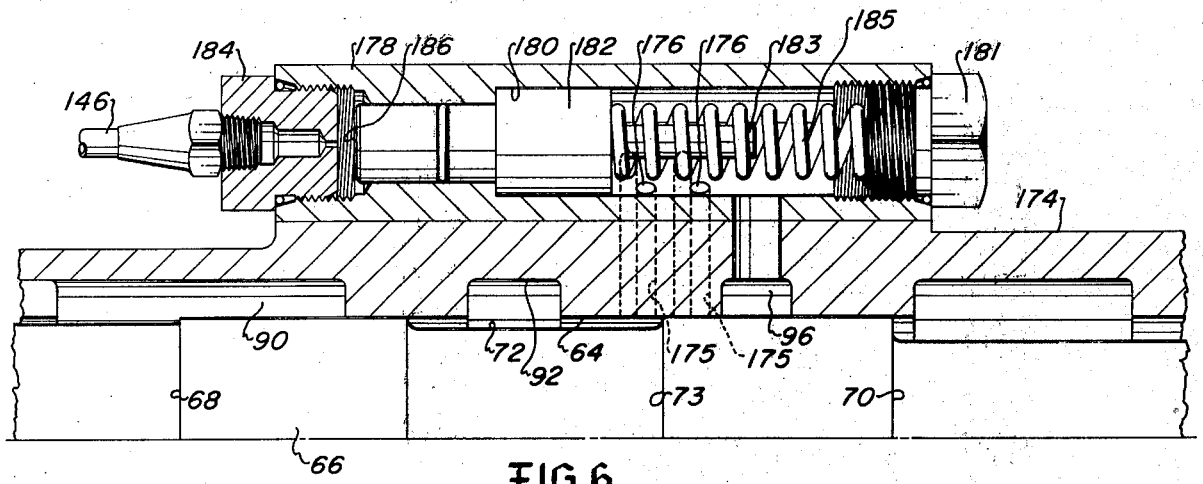

An alternate embodiment of the mechanism for controlling the movement of the fluid distributing value 102 is shown in FIGS. 5 and 6. FIG. 6 is a longitudinal section view taken generally in the same plane as the view of the drill shown in FIG. 3. The embodiment of FIGS. 5 and 6 includes a casing part 174 which is similar to the casing part 46 in substantially all respects except as herein noted. The casing part 174 includes a plurality of passages 175 which open into the bore 64 between the annular recesses 92 and 96. The passages 175 are arranged in a staggered pattern with respect to the longitudinal axis of the bore 64.

The embodiment of FIGS. 5 and 6 also includes a casing portion 178 which is removably fastened to the casing part 174 and includes a stepped bore 180 which is closed at opposite ends by threaded plugs 181 and 184. The removable casing portion 178 also includes a plurality of passages 176 which open into the bore 180 and which are aligned with the respective passages 175. In FIG. 5 certain components are omitted and part of the casing portion 178 is broken away to show the staggered relationship of the passages 175–176. As shown in FIGS. 5 and 6 the groove 96 is in communication with the bore 180 and the passages 175–176. A stepped piston 182 is disposed in the bore 180 and is biased into the position shown in FIG. 6 by a coil spring 185. The piston 182 includes an integral projection 183 which limits movement of the piston toward the plug 181 and guides the spring 185. The piston 182 also includes a transverse face 186 on the end of the piston opposite the projection 183. The conduit 146 leading from the regulator 150 is connected to conduct pressure fluid to act against the piston face 186.

In response to the introduction of pressure fluid to act against the piston face 186 at variable pressure as controlled by the pressure regulator 150 the piston 182 may be moved to cover one or more of the passages 175–176 thereby controlling the communication of pressure fluid in chamber 154 and conduit 158 to the groove 96 in accordance with the position of the control edge 73 on the piston hammer 66. The passages 175–176 are positioned in such a pattern that the embodiment of FIGS. 5 and 6 also provides for substantially stepless control of the hammer stroke length and impact blow energy. The advantage of the embodiment of FIGS. 5 and 6 for controlling the movement of the valve 102 is that the onset of movement of the valve is delayed and the total time for shifting of the valve, once movement is initiated, is somewhat faster than the embodiment of FIG. 3. Faster movement of the valve 102 tends to prevent leakage of high pressure fluid from the groove 120 across the groove 122 and to the low pressure groove 126 in the valve. Moreover, faster shifting of the valve 102 from the position shown in FIG. 3 may also tend to increase the energy stored in the accumulator 78 which is absorbed during the phase of arresting the movement of the hammer 66 during its return stroke.

What is claimed is:

1. A hydraulic rock drill system comprising:

a source of hydraulic pressure fluid;

a hydraulic pressure fluid actuated percussion rock drill operable to be in communication with said source and including;

a. a casing having a cylinder bore;

b. an impact receiving member;

c. a pressure fluid reciprocable piston hammer disposed in said bore and responsive to pressure fluid acting thereon to transmit impact blows to said member;

d. a fluid distributing valve adapted for reciprocating movement in response to pressure fluid acting thereon for controlling the flow of pressure fluid to and from said bore to effect reciprocation of said hammer; and, e. a conduit in communication with said bore for conducting pressure fluid to effect reciprocation of said valve;

first means associated with said conduit for controlling the fluid pressure therein whereby the movement of said distributing valve may be controlled to vary the impact blow energy transmitted to said impact receiving member by said hammer; and, second means providing for remote control of said first means to control the movement of said distributing valve.

2. The invention set forth in claim 1 wherein:

said first means includes a pressure fluid controlled member responsive to a pressure fluid signal for effecting control of the movement of said distributing valve.

3. The invention set forth in claim 2 wherein:

said second means comprises an adjustable pressure regulator and conduit means interconnecting said pressure regulator and said first means whereby the fluid pressure signal acting on said pressure fluid controlled member may be varied to provide substantially stepless control of the impact blow energy transmitted to said impact receiving member by said hammer.

4. The invention set forth in claim 3 wherein:

said rock drill system includes a portable drilling rig including an undercarriage, positioning means mounted on said undercarriage and providing a movable mounting for said rock drill, and an operator control station on said undercarriage, and said pressure regulator includes an operating member disposed at said operator control station and providing for remote control of said distributing valve to change the impact blow energy transmitted to said impact receiving member.

5. The invention set forth in claim 1 wherein:

said source of pressure fluid includes means for providing pressure fluid to said rock drill at variable pressure and flow rate in accordance with the variation of impact blow energy transmitted to said impact receiving member by said hammer and whereby the fluid power input to said rock drill remains substantially constant.

6. The invention set forth in claim 5 wherein:

said means for providing pressure fluid to said rock drill comprises a variable displacement pump.

7. The invention set forth in claim 6 wherein:

said pump includes control means for providing fluid to said rock drill at a substantially constant fluid power value.

8. The invention set forth in claim 2 wherein:

said first means includes a valve closure member interposed in said conduit and responsive to a predetermined pressure therein to open thereby effecting controlled movement of said distributing valve and said first means also includes piston means operable to bias said closure member in the closed position.

9. The invention set forth in claim 8 together with:

spring means interposed between said closure member and said piston means to allow fast movement of said closure member in response to a pressure force acting on said closure member exceeding the force acting on said closure member resulting from the pressure fluid signal imposed on said piston.

10. The invention set forth in claim 2 wherein:

said rock drill includes a plurality of passages spaced apart along said bore and in communication with said bore, and said first means comprises a closure member operable to be moved to a position to at least partially block one or more of said passages to control the fluid pressure acting on said distributing valve.

11. The invention set forth in claim 10 wherein:

the position of said closure member is controlled by said pressure fluid signal.

12. The invention set forth in claim 2 wherein:

said distributing valve includes at least two opposed pressure surfaces responsive to pressure fluid acting thereon for moving said distributing valve, one of said surfaces being disposed in a chamber which is operable to be in communication with said conduit, and said piston hammer includes means thereon for connecting said chamber with said conduit whereby the fluid pressure in said chamber may be controlled by said first means to effect movement of said distributing valve.

13. The invention set forth in claim 12 wherein:

said means on said piston hammer comprises an annular channel cooperable with conduit means opening into said bore from said chamber, and said channel is cooperable with said conduit for connecting said conduit to said conduit means when said piston is moving away from said impact receiving member.

14. The invention set forth in claim 13 wherein:

said piston hammer includes a first pressure surface exposed to pressure fluid acting thereon to continuously urge said piston hammer away from said impact receiving member, said piston hammer further includes a second pressure surface upon which pressure fluid controlled by said distributing valve acts to move said piston hammer toward said impact receiving member, and the movement of said distributing valve to supply pressure fluid to move said piston hammer toward said impact receiving member is effected upon a reduction in the fluid pressure in said chamber.

15. A hydraulic rock drill system comprising:

a source of hydraulic pressure fluid;

a hydraulic pressure fluid actuated percussion rock drill operable to be in communication with said source and including;

a. a casing having a cylindrical bore;

b. an impact receiving member;

c. a pressure fluid reciprocable piston hammer disposed in said bore and responsive to pressure fluid acting thereon to transmit impact blows to said impact receiving member;

d. a distributing valve for controlling the flow of pressure fluid to and from said bore to effect reciprocation of said hammer, said distributing valve being operable to control the movement of said hammer to vary the impact blow energy transmitted to said impact receiving member by said hammer; and, said source of pressure fluid includes means for providing pressure fluid to said rock drill at variable pressure and flow rate in accordance with the variation of impact blow energy transmitted to said impact receiving member by said hammer and whereby the fluid power input to said rock drill remains substantially constant.

16. The invention set forth in claim 15 wherein:

said means for providing pressure fluid to said rock drill comprises a variable displacement pump.

17. The invention set forth in claim 16 wherein: said pump includes control means for providing pressure fluid to said rock drill at a substantially constant fluid power value.

* * * * *